United States Patent [19]

Bohan, Jr. et al.

[11] Patent Number: 4,789,329

[45] Date of Patent: Dec. 6, 1988

[54] THERMOSTATICALLY OPERATED FUEL VALVE CONTROL CIRCUIT

[75] Inventors: John E. Bohan, Jr., Minneapolis; John L. Erdman, Eden Prairie; Marvin D. Nelson, Edina; James W. Ratz, Bloomington, all of Minn.

[73] Assignee: Honeywell Inc., Minneapolis, Minn.

[21] Appl. No.: 158,443

[22] Filed: Feb. 22, 1988

[51] Int. Cl.[4] ..... F23Q 9/08

[52] U.S. Cl. ..... 431/46

[58] Field of Search ..... 431/45, 46

[56] References Cited

U.S. PATENT DOCUMENTS

| | | | |
|---|---|---|---|
| 3,975,136 | 8/1976 | Baysinger et al. | 431/74 |
| 4,034,270 | 7/1977 | Matthews | 361/256 |
| 4,188,181 | 2/1980 | Rippelmeyer et al. | 431/66 |
| 4,249,696 | 2/1981 | Donnelly et al. | 236/46 R |
| 4,333,605 | 6/1982 | Peters | 236/78 R |
| 4,340,173 | 7/1982 | Kompelien | 236/46 R |
| 4,360,338 | 11/1982 | Katchka | 431/46 |
| 4,435,150 | 3/1984 | Rippelmeyer | 431/46 |
| 4,565,519 | 1/1986 | Carignan | 431/46 |
| 4,632,303 | 12/1986 | Rodittis | 236/10 |

*Primary Examiner*—Carroll B. Dority, Jr.
*Attorney, Agent, or Firm*—Alfred N. Feldman

[57] ABSTRACT

A control circuit for a fuel valve in a gas fired furnace controlled by an electronic thermostat is disclosed. The thermostat requires a load current to properly operate, and a pickup and hold circuit along with a time delay circuit are integrated to control a load current circuit to provide the correct load current for the thermostat.

7 Claims, 1 Drawing Sheet

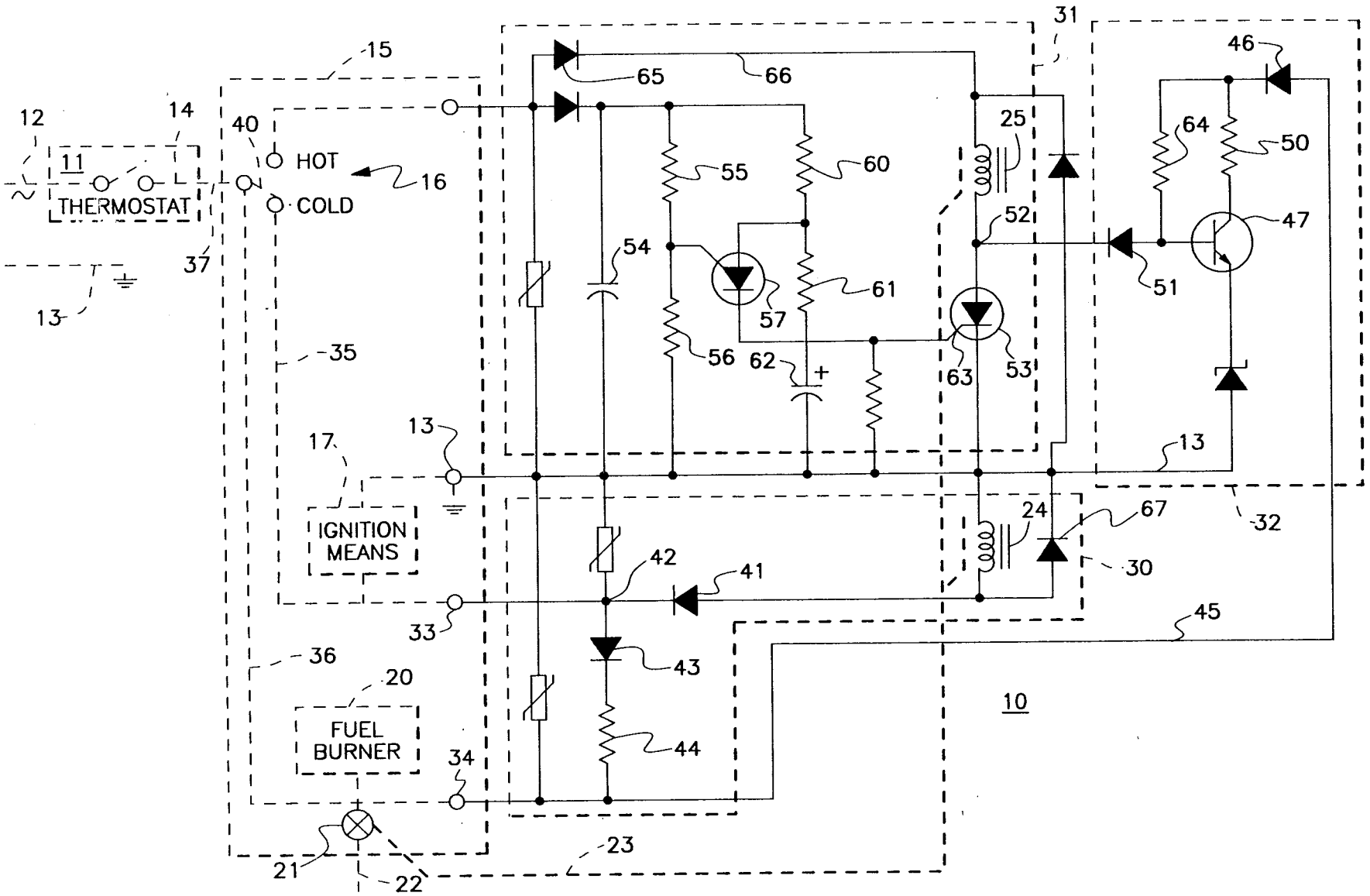
HOT
COLD
THERMOSTAT
IGNITION MEANS
FUEL BURNER

THERMOSTATICALLY OPERATED FUEL VALVE CONTROL CIRCUIT

BACKGROUND OF THE INVENTION

Fuel burners, and particularly gas fired furnaces, operate under the control of thermostats. The overall system normally includes an ignition source, a fuel valve for pilot and main fuel control, and a temperature responsive switch to prove the existence of a pilot flame prior to introducing the main fuel flow.

In conventional gas fired furnaces, the presence of a pilot flame is proved by a temperature responsive switch that operates in response to the presence or absence of a pilot flame. The time for this switch to operate is a finite period of time as the switch may be a bimetal operated flame responsive member. In order to allow for the system to properly function, the system typically also includes a time delay circuit to allow complete stabilization of the pilot flame after the pilot flame sensing switch has operated. These time delays can be of sufficient length to cause problems in modern day electronic type thermostats. Many of the present day thermostats require a continuous current load when the thermostat is closed (that is, calling for heat). This current loading must take into consideration the various levels of current drawn by the fuel valve during its various stages of operation.

SUMMARY OF THE INVENTION

The present invention is directed to a fuel burner control system that can be considered as a system installed in a conventional gas fired furnace. This type of system utilizes an ignition means, such as a direct spark provided across a gap by a step-up transformer, and a bimetal operated switch which moves from a cold position to a hot position in response to the existence of a pilot flame. The fuel or gas valve associated with this equipment typically is a two stage valve. A separate pilot valve structure operates and in turn supplies a fuel pressure to the second section of the valve in order to insure safe operation. The second section opens the main fuel line to the burner when an appropriate signal is present indicating that a pilot flame has been present for a sufficient period of time to heat a thermally responsive switch, and to stabilize.

This type of valve structure normally utilizes a higher pull-in current to the pilot valve operator than is required for maintenance of the open state once it has occurred. These changes in current flow make it essential that systems using the modern day thermostat (that requires a minimum current load) be provided with additional circuitry that responds to the state of operation of the overall system. At its start-up, the system requires a first level of current load that is significantly different than the flow of current after the unit is in operation. The reason for this is that the thermostat "sees" current changes in the normal operation, and therefore the amount of current drawn by the load current circuit means must be adjusted.

The present circuitry provides the interaction between the thermostat, the temperature responsive pilot operated switch, and the variations in current flow to initially open and hold open the pilot valve. All of the functions are properly interrelated to allow for a correct current flow through the thermostat when a call for heat exists.

In accordance with the present invention, there is provided a control circuit for fuel valve means adapted for use with a heating system having a spark ignition device, a flame responsive switch, and a thermostat requiring an electrical load current, including: fuel valve means having pilot valve operating means and main fuel operating means; pickup and hold circuit means for said pilot valve operating means including connection means connected to a source of power through said thermostat upon a call for system operation and said flame responsive switch when said switch is in a cold position to thereby energize said pilot valve operating means; load current circuit means including connection means connected to draw a first level of said load current through said thermostat upon said call for operation of said system; time delay circuit means including connection means connected to said source of power through said thermostat upon said call for system operation and said flame responsive switch when said flame responsive switch is in a hot position to energize said time delay circuit means; said time delay circuit means including said main valve operating means; and said time delay circuit connection means connected to said load current circuit means and causing said load current circuit means to maintain said load current upon said time delay circuit means timing out a time delay interval.

BRIEF DESCRIPTION OF THE DRAWING

A complete control circuit for a fuel valve means is disclosed in the single FIGURE.

DESCRIPTION OF THE PREFERRED EMBODIMENT

In the single disclosed FIGURE, a complete control circuit 10 is provided for a conventional gas fired furnace 15. The system is adapted to be operated by a thermostat generally disclosed at 11. The thermostat 11 is an electronic type of thermostat that requires a current loading when operated. There are numerous thermostats of this type on the market, and one can be identified as a T8600 type of thermostat as sold by Honeywell. There are a number of other comparable thermostats on the market and are generally of a night setback, electronic design. The only thing that is material to the present invention is that thermostat 11 can open and close a circuit between a conductor 12 and a ground supply 13 to an output conductor 14 in response to temperature.

A conventional furnace is disclosed at 15 and includes a bimetal operated heat responsive switch means generally disclosed at 16. The furnace 15 has an ignition means 17 that could be a conventional step-up transformer to convert the line voltage to an ignition voltage. The furnace 15 is completed by the inclusion of a fuel burner 20 that typically would have both a pilot burner and a main burner. Fuel is supplied to the burner 20 from a fuel valve means 21 that is connected to a source of fuel 22. The fuel valve means 21 is linked at 23 to a pair of operating members 24 and 25. The operating member 24 is a pilot valve operator, while operator 25 is a main valve operator. These typically are electromagnetically operated or solenoid structures, and are conventional in the valve structure. Typically a pilot valve section of the valve 21 is opened with a first level of energization, and then the energization is reduced to maintain the pilot valve section in an open position. Once the pilot valve section of the valve 21 is opened, gas pressure is available to combine with the function of the solenoid operator 25 to supply main fuel to the fuel burner 20. This description is by way of background, and is not directed to a physical structure for any particular valve model.

Within the control circuit 10 there are three general operating units. The first is disclosed at 30 and is a circuit designed to pickup and hold the pilot valve operator 24 in operation. A second unit within the circuit 10 is disclosed at 31, and is a time delay circuit that is used to operate the main valve operator 25. The third element of the circuit is a load current circuit means 32 that is designed to provide the necessary minimum loading to the thermostat 11 in the closed position, and during the various phases of operation of the overall control circuit 10.

The pickup and hold circuit 30 is connected to a ground 13 which is common to the ground for the power supply. The pickup and hold circuit means 30 further has a pair of terminals 33 and 34 that are connected respectively to conductors 35 and 36. The conductor 36 is connected at 37 to the conductor or output connection from the thermostat 11. This conductor is common to a center element 40 of the flame responsive switch means 16. In the position shown (the cold position), the element 40 of the flame responsive switch 16 connects the conductor 37 to the conductor 35. In the position shown, whenever the thermostat 11 closes, power is supplied to both the conductors 35 and 36 which in turn supplies voltage to the terminals 33 and 34.

When power is supplied to the terminal 33, the ignition means 17 is connected directly across the power source, and provides an ignition potential to generate a spark. At this same time the terminal 33 is connected through the solenoid pilot operator 24 to ground 13. A diode 41 and a node 42 complete a further circuit. A flyback diode 67 is required to hold in the pilot solenoid. The node 42 is connected to a further diode 43 and resistor 44 so that a complete circuit to the thermostat 11 can be maintained while the flame responsive switch 16 is in transition from the cold position to the hot position. That transition indicates that a pilot flame has been generated and allows the removal of power from the conductor 35 to de-energize the ignition means 17. Once the member 40 of the flame responsive switch 16 moves from the cold position, a reduced amount of current is drawn through the operating member or solenoid 24 through the diode 43 and the resistor 44 to reduce the potential to the pilot valve section thereby holding it open at a lower current drain than would be necessary to originally open the pilot valve.

During the initial stages of operation, the load current circuit means 32 is drawing current through the conductor 36 to the terminal 34 by way of conductor 45 through a diode 46 and a transistor 47 to the ground 13. This circuit includes a relatively small resistor 50 which allows the transistor 47 to draw the correct amount of current through the conductor 36 and into the load current circuit means 32 to properly load the thermostat 11. The transistor 47 at this point in time is biased to an "on" state through resistor 64.

The silicon controlled rectifier 53 is an output switch for the time delay circuit means 31. The time delay circuit means 31 is a conventional capacitor-resistor type of time delay circuit in which a capacitor 54, along with a voltage divider made of resistors 55 and 56, supply a reference trigger voltage to a further gated solid state switch 57. The gated solid state switch 57 is many times referred to as a PUT, and the timer circuit is completed by a voltage divider network made up of the resistors 60, 61, and a capacitor 62. The firing of the solid state switch means 57 provides a signal at a gate 63 for the solid state switch means 53, and triggers it into conduction. This drops the node 52 in voltage causing the transistor 47 to be turned "off" through diode 51. This then allows current to be drawn instead through the main solenoid 25 to maintain proper current loading through the thermostat 11 by the silicon controlled rectifier 53 to the ground 13. The firing of the silicon controlled rectifier 53 completes a circuit through a diode 65 and a conductor 66. This supplies the necessary voltage from the hot terminal of the flame responsive switch means 16 to keep the fuel burner 20 in operation in response to the main fuel operating means 25.

The overall operation of this system entails the closing of the thermostat 11 to supply power to a pickup and hold circuit means 30, which causes the pilot valve actuator 24 to become operative. At this same time energy is supplied through the cold terminal of the flame responsive switch means 16 to the ignition means 17. The ignition means 17 provides an ignition spark to energize the pilot fuel. This causes heat to be applied to the flame responsive switch means 16 and the switch 16 then operates to shift the element 40 to the hot terminal. This disconnects the ignition means 17, while energizing the time delay circuit means 31. During this time, the pickup and hold circuit 30 has shifted from a pickup current level to a hold current level, while also drawing an appropriate energizing current through the load current circuit means 32. As soon as the time delay circuit means 31 operates, the main valve operator 25 is energized. A current path for the load current circuit means 31 is shifted so that current is drawn through the main solenoid 25, the diode 65, and further through the silicon controlled rectifier 53. The combined current drains in the system are appropriate for the thermostat 11.

With the present arrangement, a system having the necessary pickup and hold function, the current drain function, and an appropriate time delay function to operate with the flame responsive switch 16 is provided. This circuit provides an efficient and comprehensive operating arrangement for a gas fired furnace that is in turn controlled by a solid state programmable thermostat that requires a continuous load current for proper operation. While a specific circuit implementation has been disclosed, the applicants wish to be limited in the scope of their invention solely by the scope of the appended claims.

The embodiments of an invention in which an exclusive property or right is claimed are defined as follows:

1. A control circuit for fuel valve means adapted for use with a heating system having a spark ignition device, a flame responsive switch, and a thermostat requiring an electrical load current, including: fuel valve means having pilot valve operating means and main fuel operating means; pickup and hold circuit means for said pilot valve operating means including connection means connected to a source of power through said thermostat upon a call for system operation and said flame responsive switch when said switch is in a cold position to thereby energize said pilot valve operating means; load current circuit means including connection means connected to draw a first level of said load current through said thermostat upon said call for operation of said system; time delay circuit means including connection means connected to said source of power through said thermostat upon said call for system operation and said flame responsive switch when said flame responsive switch is in a hot position to energize said time delay circuit means; said time delay circuit means including said main valve operating means; and said time delay circuit connection means connected to said load current circuit means and causing said load current circuit means to maintain said load current upon said time delay circuit means timing out a time delay interval.

2. A control circuit for fuel valve means as claimed in claim 1 wherein said fuel valve means is a fuel valve with said pilot valve operating means and said main fuel operating means; each of said operating means being an individual electromagnetic operator with each operator having an individual operating coil.

3. A control circuit for fuel valve means as claimed in claim 2 wherein said pickup and hold circuit means has a current flow through said pilot valve operating coil, said thermostat, and said flame responsive switch in said cold position of sufficient magnitude to energize said pilot valve operating means to an open position; said flame responsive switch moving to a hot position upon the presence of a pilot flame for said heating system; and said movement of said flame responsive switch to said hot position reducing current flow to said pilot valve operating coil to hold said pilot valve means in said open position.

4. A control circuit for fuel valve means as claimed in claim 3 wherein said time delay circuit means times out an interval for said flame responsive switch to stabilize in said hot position.

5. A control circuit for fuel valve means as claimed in claim 4 wherein said time delay circuit means upon operating causes said load current circuit means to be switched from said first level of load current to a different path for the load current.

6. A control circuit for fuel valve means as claimed in claim 5 wherein said reduced level of load current is diverted by said time delay circuit means upon said time delay circuit means timing out.

7. A control circuit for fuel valve means as claimed in claim 6 wherein said time delay circuit means includes a gated solid state switch means with a gate connected to a resistor-capacitor network; said resistor-capacitor network being caused to rise in voltage over a time delay interval with said voltage causing said solid state switch means to conduct; said load current circuit means including a transistor with said transistor having an element connected to said solid state switch means; said transistor conducting said first level of load current when said solid state switch means is not conducting; and said element causing said transistor to become non-conductive when said solid state switch means conducts; said level of load current being diverted through said solid state switch means.

* * * * *